US012571193B2

(12) United States Patent
Fan et al.

(10) Patent No.: US 12,571,193 B2
(45) Date of Patent: Mar. 10, 2026

(54) TOILET

(71) Applicant: LIXIL (China) Investment Co., Ltd., Shanghai (CN)

(72) Inventors: Zhongde Fan, Shanghai (CN); Li Jiang, Shanghai (CN); Yongze Liu, Shanghai (CN); Yulin Li, Shanghai (CN); Xiaolong He, Shanghai (CN); Dan Cao, Shanghai (CN); Jian Zhang, Shanghai (CN); Jiangjiang Ye, Shanghai (CN)

(73) Assignee: LIXIL (CHINA) Investment Co., Ltd., Shanghai (CN)

( * ) Notice: Subject to any disclaimer, the term of this patent is extended or adjusted under 35 U.S.C. 154(b) by 202 days.

(21) Appl. No.: 18/281,020

(22) PCT Filed: Mar. 7, 2022

(86) PCT No.: PCT/CN2022/079472
§ 371 (c)(1),
(2) Date: Sep. 8, 2023

(87) PCT Pub. No.: WO2022/188728
PCT Pub. Date: Sep. 15, 2022

(65) Prior Publication Data

US 2025/0027307 A1 Jan. 23, 2025

(30) Foreign Application Priority Data

Mar. 11, 2021 (CN) ..... 202120518174.2

(51) Int. Cl.
*E03D 1/28* (2006.01)
*A47K 13/24* (2006.01)
(Continued)

(52) U.S. Cl.
CPC ..... *E03D 1/286* (2013.01); *E03D 1/38* (2013.01); *E03D 5/01* (2013.01); *A47K 13/24* (2013.01)

(58) Field of Classification Search
CPC ..... E03D 1/286
See application file for complete search history.

(56) References Cited

U.S. PATENT DOCUMENTS

2019/0038090 A1* 2/2019 Matsuda ..... H02J 50/12
2019/0112798 A1 4/2019 Higuchi et al.
(Continued)

FOREIGN PATENT DOCUMENTS

CN 204081009 U 1/2015
CN 107761872 A 3/2018
(Continued)

OTHER PUBLICATIONS

International Search Report mailed Jun. 6, 2022 in corresponding International Application No. PCT/CN2022/079472 (9 pages).
(Continued)

*Primary Examiner* — Christine J Skubinna
(74) *Attorney, Agent, or Firm* — Tyler A. Stevenson; Anna-lisa L. Gallo

(57) ABSTRACT

The present utility model relates to a toilet. The toilet comprises: a seat body having a sewage accommodating bowl; a ring flushing pipeline, the ring flushing pipeline being used for performing ring flushing on the sewage accommodating bowl; a bottom flushing pipeline, the bottom flushing pipeline being used for performing bottom flushing on the sewage accommodating bowl; and a flush valve, the flush valve being capable of being in fluid communication with at least one of the ring flushing pipeline and the bottom flushing pipeline, such that water for flushing flows to the sewage accommodating bowl via the flush valve. A first power supply apparatus is arranged in the seat body, and the first power supply apparatus is configured to supply power to the flush valve. By "sinking" the power supply apparatus which supplies power to the flush valve to the seat body of the toilet, the flexibility of supplying power to the flush valve and the flexibility of the arrangement of the power supply apparatus are achieved, thereby avoiding problems such as a layout difficulty or an electrical safety issue caused by concentrating electronic devices on a toilet lid or other positions.

17 Claims, 13 Drawing Sheets

(51) Int. Cl.
*E03D 1/38* (2006.01)
*E03D 5/01* (2006.01)

(56) References Cited

U.S. PATENT DOCUMENTS

| | | | | |
|---|---|---|---|---|
| 2020/0375417 | A1* | 12/2020 | Thorne | A47K 13/24 |
| 2021/0015314 | A1* | 1/2021 | Sylvia | E03D 9/08 |
| 2021/0106191 | A1* | 4/2021 | Chung | A47K 13/247 |
| 2021/0251440 | A1* | 8/2021 | Wu | H02J 7/0045 |

FOREIGN PATENT DOCUMENTS

| | | | | |
|---|---|---|---|---|
| CN | 208545811 | U | | 2/2019 |
| CN | 109487883 | A | | 3/2019 |
| CN | 109629650 | A | | 4/2019 |
| CN | 109797825 | A | | 5/2019 |
| CN | 209482422 | U | | 10/2019 |
| CN | 210597529 | U | | 5/2020 |
| CN | 210827727 | U | * | 6/2020 |
| CN | 211447137 | U | | 9/2020 |
| CN | 112031104 | A | | 12/2020 |
| JP | 2017048552 | A | | 3/2017 |
| KR | 102055170 | B1 | | 12/2019 |

OTHER PUBLICATIONS

Extended European Search Report for corresponding European application No. EP22766253.3, mail date Feb. 17, 2025, 10 pages.

* cited by examiner

TOILET

TECHNICAL FIELD

The present utility model relates to a toilet, and the toilet can realize the functions of ring flushing and bottom flushing, and can be compatible with common toilet lids or electronic toilet lids in use.

BACKGROUND ART

With the continuous development of science and technology, people's requirements for living standards are also constantly improving, and are reflected in all aspects of life. For example, for toilets that are indispensable in daily life, users now not only hope that the toilets can have a strong cleaning ability, but also further hope that the toilets have an attractive appearance, do not take up too much space, and have more functions and convenient compatibility.

Users' requirements for product use comfort, sanitation, environmental health, etc. are getting higher and higher, and the toilets, as sanitary devices with a high frequency of daily use, have been endowed with more and more functions, for example, they are hoped to have flushing functions, seat ring heating, deodorization, automatic flushing, automatic opening and closing of toilet lids, etc. There are a large number of electronic toilet lids with such functions installed on the market, or integrated smart toilet products with such functions.

Furthermore, there is a trend of miniaturization of the appearance of the toilets at present, and there are a variety of shorter toilet products with low-configuration appearance on the market. These low-configuration toilets generally use sunken water tanks, that is, the tops of the water tanks are the same as or slightly lower than the tops of ceramic bodies of the toilets, that is, the water tanks sink into the ceramic bodies, and some even abandon the water tanks, thereby reducing the heights of the whole toilets. Because the height difference is greatly reduced, most of such products on the market use additional water pumps to improve the flushing effect of the toilets. Employing a high-power large water pump to flush or using a water tank plus a water pump to flush and other manners can still achieve a better flushing effect under the condition of the low-configuration toilets.

However, there is a problem at present, that is, when using an electronic toilet lid having multiple functions, the electronic toilet lid needs to integrate many electronic components, thus on one hand a bottleneck in the internal structural layout of the electronic toilet lid is led, and on the other hand, the centralized arrangement of the electronic components will bring electrical risks. However, if an integrated smart toilet product comprising multiple functions is employed, the price is relatively high for users, and some users may not be able to accept it.

In addition, there is another problem, that is, on the market, there is no relatively convenient technical solution that effectively combines the electronic toilet lid having multiple functions with the aforementioned shorter toilet products with low-configuration appearance without affecting the functions. Furthermore, because there are still a large number of traditional users, they are still willing to use a relatively traditional toilet lid only having a covering function, but do not expect to use the electronic toilet lid, there is also a need for a solution that uses this traditional toilet lid for the toilets, especially for a solution of use for the aforementioned shorter toilets with low-configuration appearance.

So far, in the field of sanitary ware for toilets, there has always been a solution that is compatible with the aforementioned electronic toilet lid or traditional common toilet lid, at the same time, does not affect the functions, and preferably can be adapted to the low-configuration toilets.

Summary of the Utility Model

To this end, the present utility model provides a toilet. The toilet comprises: a seat body having a sewage accommodating bowl; a flushing pipeline, the flushing pipeline being used for performing flushing on the sewage accommodating bowl, and a flush valve, the flush valve being capable of being in fluid communication with the flushing pipeline, such that water for flushing flows to the sewage accommodating bowl via the flush valve; wherein a first power supply apparatus is arranged in the seat body, and the first power supply apparatus is configured to supply power to the flush valve.

By "sinking" the power supply apparatus which supplies power to the flush valve to the inside of a seat body part (for example, a ceramic bowl) of the toilet, the flexibility of supplying power to the flush valve and the flexibility of the arrangement of the power supply apparatus are achieved, thereby avoiding problems such as a layout difficulty or an electrical safety issue caused by concentrating electronic devices on a toilet lid or other positions.

Preferably, the toilet may comprise a water tank, the water tank containing water for flushing; and a water level sensor, the water level sensor being arranged in the water tank to sense a water level in the water tank; wherein the first power supply apparatus is configured to supply power to the water level sensor.

Since the power supply apparatus that has been arranged in the seat body of the toilet can also supply power to the water level sensor located in the water tank, the power supply apparatus can provide power supply functions for more components or apparatuses, thereby facilitating the overall power supply layout and safety control of the toilet, while also improving the location flexibility of supplying power to the water level sensor.

Advantageously, the toilet may further comprise a toilet lid arranged on the seat body, wherein the toilet lid is implemented as an electronic toilet lid, and the first power supply apparatus is configured to supply power to the electronic toilet lid.

By using the power supply apparatus located in the seat body of the toilet to supply power to the electronic toilet lid to realize its functions such as drying, flushing, and deodorization, the difficulty of designing and manufacturing the electronic toilet lid itself can be reduced, and at the same time, more and more flexible electrical layout possibilities are provided.

In some embodiments, a control circuit board can be arranged in the seat body, wherein the first power supply apparatus is an external power transmission power supply or a battery, and the external transmission power supply or the battery can be electrically connected to the control circuit board to supply power via the control circuit board.

With the help of the control circuit board, power can be directly supplied to the aforementioned components such as the flush valve, the electronic toilet lid, and the water level sensor of the toilet, and at the same time, these components can be electronically controlled, for example, these components are controlled to be opened, closed, etc.

Advantageously, the flushing pipeline comprises a ring flushing pipeline and a bottom flushing pipeline, wherein the ring flushing pipeline is used for performing ring flushing on the sewage accommodating bowl, and the bottom flushing pipeline is used for performing bottom flushing on the sewage accommodating bowl. With the help of the ring flushing pipeline and the bottom flushing pipeline, flushing is performed on the sewage accommodating bowl from different parts, thereby improving the flushing efficiency and facilitating the setting of subsequent flushing control.

In the embodiment provided with a water tank, the water tank can be at least partly disposed in the seat body, a water pump connected to the water tank is also arranged in the seat body, and the water pump can pump water in the water tank and deliver the pumped water to the flush valve at a pressure.

By disposing the water pump, the flushing intensity of the toilet can be increased and the flushing efficiency can be improved, which is especially important for low-configuration toilets.

In the embodiment provided with a water pump, a second power supply apparatus for supplying power to the water pump is further arranged in the seat body, and a voltage provided by the second power supply apparatus is higher than a voltage provided by the first power supply apparatus.

By providing the second power supply apparatus with a higher voltage and also "sinking" the second power supply apparatus in the seat body of the toilet, the need of power supply to the water pump can be realized, and problems such as a layout difficulty or an electrical safety issue caused by arranging the power supply in other positions can be avoided.

Preferably, the flush valve is provided with a first end communicated with a water outlet of the water pump, a second end communicated with a spray port of the seat body and a third end communicated with a spray nozzle, wherein an air isolation apparatus is disposed between the first end and the second end or the third end, so as to prevent water from flowing back into the water tank.

With the aid of the air isolation apparatus, siphoning can be avoided when a water draining port of the water tank is lower than a water surface height in the toilet, which will cause the problem that dirty water in the toilet flows back into the water tank from the spray port, thereby ensuring the cleanliness of water stored in the water tank, avoiding the occurrence of mold and odor in the water tank caused by pollution of the water tank by sewage, and further reducing the frequency of cleaning the water tank by users.

In addition, the toilet may further comprise a toilet switch, and the control circuit board is in communication connection with the toilet switch, so that an instruction of supplying power to the water pump can be sent out in response to a signal from the toilet switch, and thus the water pump starts pumping water.

Through the signal setting of the toilet switch and the communication connection between the control circuit board and the toilet switch, power can be supplied to the water pump at a selected timing, and the duration of power supply can also be selected.

Advantageously, the toilet may further comprise a water inlet valve, through which water flows into the water tank, wherein the control circuit board is in communication connection with the water level sensor, so that opening and closing of the water inlet valve can be controlled in response to a signal of the water level sensor.

Through the control of the control circuit board, the opening and closing of the water inlet valve can be controlled, thereby helping to ensure that the water tank is always full of water in a standby state.

Additionally, in the embodiment provided with the control circuit board, the control circuit board is in communication connection with the flush valve, so that a flushing water amount and/or flush timing of the ring flushing or bottom flushing via the flush valve can be controlled.

Since the control circuit board can control the opening and closing of the flush valve, different flushing needs can be met with high efficiency, for example, the flushing water amount can be increased or decreased, and a favorable flushing sequence or flushing duration can also be arranged to ensure the user experience.

Particularly advantageously, the water tank can be arranged at the position of the bottom in the seat body. Thereby, a very low-configuration toilet arrangement can be realized; and in addition, a space at the bottom of the seat body can be fully utilized for the water tank to increase the possibility of expanding a volume of the water tank, or at least improve the flexibility of the water tank arrangement.

It is also advantageous that the first power supply apparatus is arranged below the toilet lid. Therefore, when the first power supply apparatus needs to be maintained or overhauled, the first power supply apparatus can be easily touched by removing the toilet lid. More advantageously, the first power supply apparatus is arranged in a space below a base plate of the toilet lid in the seat body. Therefore, on one hand, a compact arrangement inside the seat body can be provided, and on the other hand, the positioning of the first power supply apparatus inside the seat body can also be determined by means of the base plate.

BRIEF DESCRIPTION OF THE DRAWINGS

It should be noted that the drawings referred to are not all drawn to scale but may be exaggerated to illustrate various aspects of the present utility model, and in this respect, the drawings should not be interpreted as limiting.

LIST OF REFERENCE NUMERALS

Figure 1:
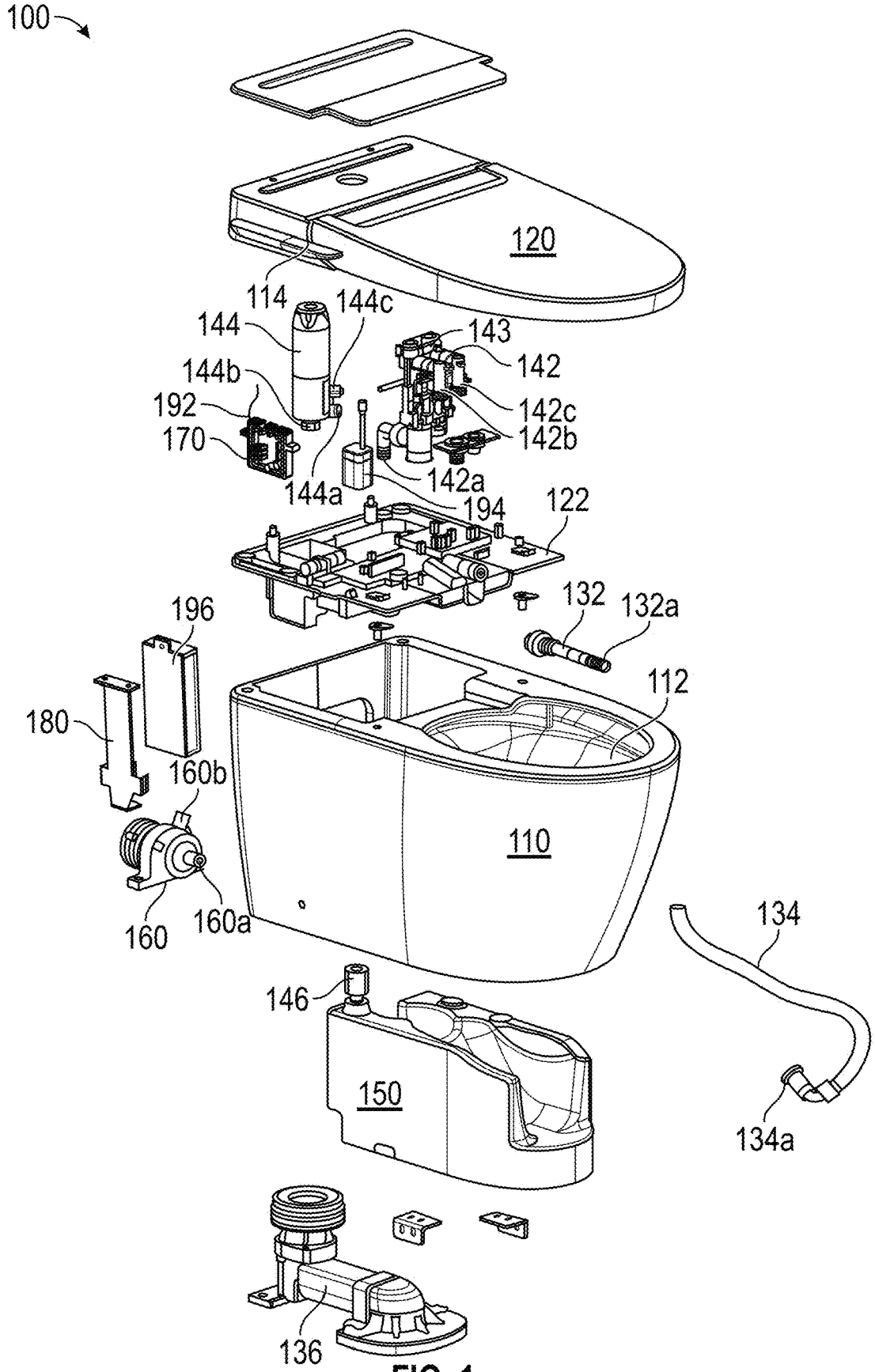
FIG. 1 exemplarily shows a structural perspective view of a toilet according to a first embodiment of the present utility model, wherein each component is installed in a seat body of the low-configuration toilet.

100 toilet;
110 seat body;
112 sewage accommodating bowl;
112*a* sewage accommodating surface;
113 sewage outlet;
114 toilet switch;
120 toilet lid;
122 base plate;
132 ring flushing pipeline;
132*a* spray nozzle;
134 bottom flushing pipeline;
134*a* spray port;
136 sewage discharge pipe;
142 flush valve;
142*a* first end (of the flush valve);
142*b* second end (of the flush valve);
142*c* third end (of the flush valve);
143 air isolation apparatus;
144 filter;
144*a* first port (of the filter);
144*b* second port (of the filter);
144*c* third port (of the filter);
146 water inlet valve;
150 water tank;
160 water pump;
160*a* water inlet (of the water pump);
160*b* water outlet (of the water pump);
170 control circuit board;
180 bracket;
192 external power transmission power supply;
194 battery;
196 second power supply apparatus.

DETAILED DESCRIPTION OF EMBODIMENTS

In the present utility model, the term "toilet" refers to an entire cleaning system for flushing the toilet, which, for example, comprises a seat body having a sewage accommodating bowl, a toilet lid of the toilet, various pipelines, wires, connectors, accessories and the like. It can be understood that the toilet itself of the present utility model is not limited to types, and intelligent toilets, direct-flushing toilets, siphon toilets, low-configuration toilets, and various traditional toilets can all be within the scope of the present utility model.

The toilet 100 of the present utility model comprises a seat body 110, for example, a seat body 110 (also known as a basin body) made of a ceramic material or a resin material. The seat body itself can be a wall-mounted or traditional non-wall-mounted seat body. The toilet lid of the toilet can be directly placed on a top surface of the seat body 110 of the toilet 100. The toilet lid 120 according to the present utility model can be a traditional toilet lid (i.e., a toilet lid that only has a function of covering the sewage accommodating bowl 112 of the toilet) or an electronic toilet lid (also known as "intelligent toilet lid"), and the electronic toilet lid may provide various types of functions such as a toilet cleaning function, a drying function, a disinfection function and a heating function according to user needs.

The seat body 110 has the sewage accommodating bowl 112 (also known as a sewage accommodating pool), and the sewage accommodating bowl 112 has an appropriate size and shape to facilitate the use of the toilet by a user. The sewage accommodating bowl 112 generally comprises a sewage accommodating surface 112*a* and a sewage outlet located at the bottom of the bowl. It can be understood that the sewage accommodating surface 112*a* (also referred to as an inner wall of the sewage accommodating bowl and a sewage receiving surface) extends downward from the top of the sewage accommodating bowl 112 and converges to the sewage outlet. Sewage flows from the sewage outlet to a sewage discharge pipe 136, thereby flowing out of the seat body 110 of the toilet.

The toilet 100 according to the present utility model may comprise a flushing pipeline for flushing the sewage accommodating bowl 112. Advantageously, the flushing pipeline may comprise a ring flushing pipeline 132, wherein the ring flushing pipeline 132 is used for realizing ring flushing on the sewage accommodating bowl 112, mainly the sewage accommodating surface 112*a* of the sewage accommodating bowl. The so-called "ring flushing" refers to a flushing manner that supplying is performed to the sewage accommodating bowl 112 from an upper part of the sewage accommodating bowl 112, especially an inner edge of the upper part by approximate one circle. A flushing port may be provided on the inner edge of the upper part of the sewage accommodating bowl 112, and flushing water in the ring flushing pipeline 132 flows into the sewage accommodating bowl 112 via the flushing port for ring flushing. In the ring flushing process, the flushing water flushes the sewage accommodating surface 112*a* from top to bottom, so as to fully clean the sewage accommodating surface 112*a* without leaving any dead space. Preferably, the structure of the sewage accommodating surface 112*a* is disposed to facilitate the rotation of the water flow (also known as "swirling water outlet"), so that the water flowing out from the flushing port swirls while flushing the sewage accommodating surface 112*a* from top to bottom, thereby cleaning the sewage accommodating surface 112*a* and the sewage accommodating bowl 112 more thoroughly. It is conceivable that the flushing port can also be directly opened on any suitable position of the sewage accommodating surface 112*a* halfway from the top to the bottom of the sewage accommodating bowl 112. The ring flushing pipeline 132 further comprises a spray nozzle 132*a* located at the position of the flushing port.

The flushing pipeline of the toilet 100 according to the present utility model may also comprise a bottom flushing pipeline 134, wherein the bottom flushing pipeline 134 is used for realizing bottom flushing on the sewage accommodating bowl 112, mainly the bottom thereof. The so-called "bottom flushing" refers to a flushing manner that the flushing water is sprayed from a spray port 134*a* at the bottom of the sewage accommodating bowl 112 (for example, directly facing the sewage outlet 113). It will be appreciated that the ring flushing pipeline 132 and the bottom flushing pipeline 134 may communicate with a common manifold, which is connect to, for example, a water inlet valve 146 or a flush valve 142, or the ring flushing pipeline 132 and the bottom flushing pipeline 134 extend in the form of the same pipeline in some areas, but these circumstances do not change the fact that the ring flushing pipeline 132 and the bottom flushing pipeline 134 are two pipelines independent of each other.

In addition, the toilet 100 may further comprise a flush valve 142, wherein the flush valve 142 may control the flushing water to flow into the seat body 110, mainly the sewage accommodating bowl 112, via the flush valve. In the present utility model, the flush valve 142 can be selectively in fluid communication with at least one of the ring flushing pipeline 132 and the bottom flushing pipeline 134, such that the water for flushing flows to the aforementioned sewage accommodating bowl 112 via the flush valve 142 and the ring flushing pipeline 132 and/or the bottom flushing pipeline 134. In some embodiments, the flush valve 142 may be in fluid communication with both the ring flushing pipeline 132 and the bottom flushing pipeline 134 simultaneously or in timed intervals, but in other embodiments, the flush valve 142 may be in fluid communication with only the bottom flushing pipeline 134, while the water flowing into the ring flushing line 132 does not pass through the flush valve 142.

In the present utility model, the flush valve 142 is an electronically controlled valve, for example, an electronically controlled hydraulic valve, so the toilet 100 needs to supply power to the flush valve 142 to open or close the flush valve. Preferably, only one flush valve 142 is provided. When the flush valve 142 is opened, the water for flushing flows into the ring flushing pipeline 132 and/or the bottom flushing pipeline 134 via the flush valve 142. The present utility model does not exclude that other control valves, for example, electronically controlled control valves, for separately controlling a ring flushing process and a bottom flushing process are arranged between the flush valve 142 and the ring flushing pipeline 132 and/or the bottom flushing pipeline 134.

In order to supply power to the flush valve 142, the toilet 100 of the present utility model comprises a first power supply apparatus. In the present utility model, the terms "first", "second" and so on do not indicate the precedence order or priority, but only indicate that the components or apparatuses involved are independent of each other. The first power supply apparatus may at least supply power to the flush valve 142 of the toilet 100, and may also supply power to other components except the flush valve 142 (details will be described below).

Advantageously, the first power supply apparatus is arranged in the seat body 110 of the toilet 100. In other words, the first power supply apparatus is not disposed outside the seat body 110, for example, in the toilet lid 120 or located on other components outside the seat body 110, for example, a water tank (when such water tank itself is located outside the seat body).

By "sinking" the first power supply apparatus for supplying power to the flush valve 142 to the inside of the seat body 110 (e.g., a ceramic bowl) of the toilet 100, the flexibility of supplying power to the flush valve 142 and the flexibility of the arrangement of the power supply apparatus are allowed to be better provided, thereby avoiding problems such as a layout difficulty or an electrical safety issue caused by concentrating electronic devices on a toilet lid 120 or other positions of the toilet 100. In addition, "sinking" the first or other power supply apparatus to the inside of the seat body 110 of the toilet 100 can also enable the seat body 110 of the toilet 100 to be adapted to various types of toilet lids 120, for example, conventional toilet lids or electronic toilet lids, which improves the compatibility of the toilet 100 itself. More specifically, the flushing function of the toilet 100 may no longer be limited to realizing by relying on the operation of the electronic toilet lid, for example, pressing a relevant trigger key. In this case, even if the electronic toilet lid is replaced with a common toilet lid, the flushing function of the flush valve of the toilet 100 can also be triggered, that is, the required use function is retained by means of the seat body 110.

It can be understood that, in various embodiments of the present utility model, the first power supply apparatus is located below the toilet lid. When the first power supply apparatus needs to be maintained or overhauled, the first power supply apparatus can be conveniently touched by removing the toilet lid. In particular, the first power supply apparatus may be arranged in a space below the base plate of the toilet lid in the seat body. In addition, the first power supply apparatus can be positioned and supported in the seat body 110 by a bracket 180 (description will be made below) also located in the seat body 110.

In some examples, the first power supply apparatus may be arranged at the position, near one of the two sides of the seat body, in the seat body 110 (i.e., one side of the left and right sides of the user when the user sits on the toilet 100). More advantageously, when the water tank is also arranged in the seat body 110, the first power supply apparatus can be arranged adjacent to the water tank 150. In other examples, the first power supply water tank may be arranged closely adjacent to an inner side surface of an inner wall of the seat body 110. In still other examples, the first power supply water tank may be arranged close to the sewage discharge pipe 136. Preferably, the first power supply apparatus is far away from the ring flushing pipeline 132 or the bottom flushing pipeline 134 which will be described in detail below by an enough distance, so as to avoid affecting the power supply safety due to a slight leakage of a water-carrying pipeline. For example, the first power supply apparatus may be located at further rear (i.e., the direction toward the rear of the user's body when the user sits on the toilet 100) relative to the ring flushing pipeline 132 or the bottom flushing pipeline 134 in the seat body 110.

Preferably, the first power supply apparatus may be an external power transmission power supply 192 or a battery 194 (see FIG. 1). When the first power supply apparatus is the external power transmission power supply, it can be in the form of a power supply board arranged in the seat body 110, for example, a PCB board having an external power supply, but it can also be in the form of a power line, or in the form of a power line leading out from the power board. It can be understood that, in the present utility model, the first power supply apparatus, for example, the external power transmission power supply 192 or the battery 194, can be electrically connected to a control circuit board 170 (also referred to as "main control circuit board") of the toilet 100. Thus, power can be supplied to each component, for example, the flush valve 142, by means of the control circuit board 170 electrically connected to each component.

As mentioned above, the toilet 100 according to the present utility model may comprise a traditional toilet lid or an electronic toilet lid, and the toilet lid 120 is usually arranged on the seat body 110, for example, a top surface of the seat body. When the electronic toilet lid is employed, the first power supply apparatus can be configured to supply power to the electronic toilet lid to realize various functions of the electronic toilet lid, for example, toilet cleaning, drying, heating the toilet lid, disinfection and the like. However, it can be understood that the various functions of the above-mentioned electronic toilet lid can also be realized by other components of the toilet 100, for example, the various functions are realized by a cleaning apparatus, a drying apparatus, a heating apparatus, a disinfection apparatus, etc. integrated into the seat body 110. Both FIG. 1 and FIG. 2 exemplarily show the base plate 122 located in the electronic toilet lid, and relevant functional components of the electronic toilet lid can be preferably installed on the base plate 122 located inside, but it is also conceivable to dispose the relevant functional components on other components inside.

In addition, the toilet 100 according to the present utility model may further comprise a water inlet valve 146, wherein the water inlet valve 146 is preferably arranged in the water tank 150 or upstream the water tank 150. However, in an embodiment without a water tank, the water inlet valve 146 can also be arranged on a water inlet pipeline communicated with an external water source, especially at the position of a water intake close to the external water source. In some embodiments, the ring flushing pipeline 132 may be in direct fluid communication with the water inlet valve 146 or a water inlet pipeline, and not in direct fluid communication with the flush valve 142.

In the first embodiment shown in FIG. 1, the toilet 100 may comprise a water tank 150, preferably a sunken water tank (also referred to as "built-in water tank"), more preferably a water tank 150 completely sunk in the seat body 110. The toilet 100 may also be referred to as a "low-configuration" or "low-profile" toilet 100 when the sunken water tank is employed.

Since the position of the water tank 150 in the low-configuration toilet 100 is greatly lowered compared with that of the conventional toilet 100, in the embodiment shown in FIG. 1, the toilet 100 further comprises a water pump 160, wherein the water pump 160 is used to increase the flushing force for the water flushing the sewage accommodating bowl 112. FIG. 1 exemplarily shows a water inlet 160*a* and a water outlet 160*b* of the water pump 160. The water pump 160 can pump the water in the water tank 150 and deliver the pumped water to the flush valve 142 at a pressure. The water pump 160 is preferably arranged in the seat body 110 of the toilet 100, for example, it may be arranged in the water tank 150 or other appropriate positions connected to the water tank 150. It is particularly advantageous that the water tank 150 can be arranged at the position of the bottom in the seat body 110, for example, the lowest position. In addition, a shape of the water tank 150 is preferably adapted to a remaining space at the bottom of the water tank 150, so as to make full use of the space to increase the volume of the water tank.

The water pump 160 can pump the water in the water tank 150 and enables the water to spray out from the spray port 134*a* (for example, the spray port 134*a* can be arranged directly opposite to the sewage outlet 113 of the sewage accommodating bowl 112) at a certain flow rate. Thus, regardless of whether a water level of the flushing water in the water tank 150 is higher than that of the flushing water in the sewage accommodating bowl 112, the flushing of the sewage accommodating bowl 112 of the toilet 100 can actually be realized. Therefore, the position of the sunken water tank can be disposed arbitrarily according to needs, that is, the flexibility of arrangement is very high. Furthermore, the volume of the water tank 150 can be increased by making full use of the vacant position at the bottom of the seat body 110 of the toilet 100. In addition, such arrangement does not have the problem of relying on a water supply pressure, which makes it more convenient for users to use.

In this embodiment, preferably, a water level sensor (not shown) is disposed in the water tank 150 to monitor the water level in the water tank 150. Advantageously, the first power supply apparatus can supply power to the water level sensor. More advantageously, power can be supplied to the water level sensor by means of the control circuit board 170 electrically connected to the first power supply apparatus, and the control circuit board can also be in communication connection with the water level sensor, so as to realize the control over the toilet 100 on the basis of water level information of the water level sensor (for example, controlling the opening and closing of the water inlet valve 146 and/or the flush valve 142).

In addition, the flush valve 142 according to the present utility model can be provided with a first end 142*a* communicated with a water outlet 160*b* of the water pump 160, a second end 142*b* communicated with the spray port 134*a* of the seat body 110, and a third end 142*c* communicated with the spray nozzle 132*a* of the seat body 110, wherein an air isolation apparatus 143 can be disposed between the first end 142*a* of the flush valve 142 and the second end 142*b* or the third end 142*c* of the flush valve 142, so as to prevent water from flowing back into the water tank 150. Thus, siphoning can be avoided when a water draining port of the water tank 150 is lower than a water surface height in the toilet 100, which will cause the hidden trouble that the dirty water in the toilet 100 flows back into the water tank 150 from the spray port 134*a*, thereby ensuring the cleanliness of water stored in the water tank 150, avoiding the occurrence of mold and odor in the water tank 150 caused by pollution of the water tank 150 by sewage, and further reducing the frequency of cleaning the water tank 150 by users.

In the embodiment shown in FIG. 1, the specific positions of the first end 142*a*, as well as the second end 142*b* and the third end 142*c* of the flush valve 142 are shown.

Preferably, a flow distribution valve may be arranged upstream the second end 142*b* and the third end 142*c* of the flush valve 142, for example, at the position of the first end of the flush valve 142, so it is possible to choose either to communicate with the spray port 134*a* or the spray nozzle 132*a* by means of the flow distribution valve, then it is possible to further choose either to discharge water with the spray port 134*a* or the spray nozzle 132*a*, so as to meet the flushing needs of the users and save water resources. However, this is not the only control manner. For example, a flow distribution valve may not be provided at the first end of the flush valve 142, but parts for controlling the ring flushing and the bottom flushing are placed on each pipeline of the ring flushing pipeline 132 and the bottom flushing pipeline 134, for example, a first control valve located in the ring flushing pipeline 132 or in fluid communication with the ring flushing pipeline 132 and a second control valve located in the bottom flushing pipeline 134 or in fluid communication with the bottom flushing pipeline 134 are arranged.

Advantageously, as mentioned above, the toilet 100 may comprise a control circuit board 170 electrically connected to the first power supply apparatus. The control circuit board 170 may be in communication connection with the flush valve 142 (or with the first control valve and/or the second control valve), so that the flushing water amount and/or flushing timing of the ring flushing or bottom flushing via the flush valve 142 can be controlled. For example, the water amount of the ring flushing can be less than that of the bottom flushing, but the ring flushing can be earlier than the bottom flushing, for example, a few seconds earlier, the ring flushing process and the bottom flushing process can overlap each other, or can be performed simultaneously or successively, and these are all within the scope of protection of the present utility model.

The toilet 100 according to the present utility model may further comprise a toilet switch 114, and the control circuit board 170 is in communication connection with the toilet switch 114, so that an instruction of supplying power to the water pump 160 can be sent out in response to a signal from the toilet switch 114, and thus the water pump 160 starts pumping water. Of course, it is also conceivable to delay a period of time after receiving the signal from the toilet switch 114, for example, the instruction of supplying power to the water pump 160 is sent out after a few milliseconds to a few seconds. Advantageously, the toilet switch 114 may be in the form of a flush button, an inductive switch or a foot touch switch, all of which can be activated or switched by the users.

Figure 5A:
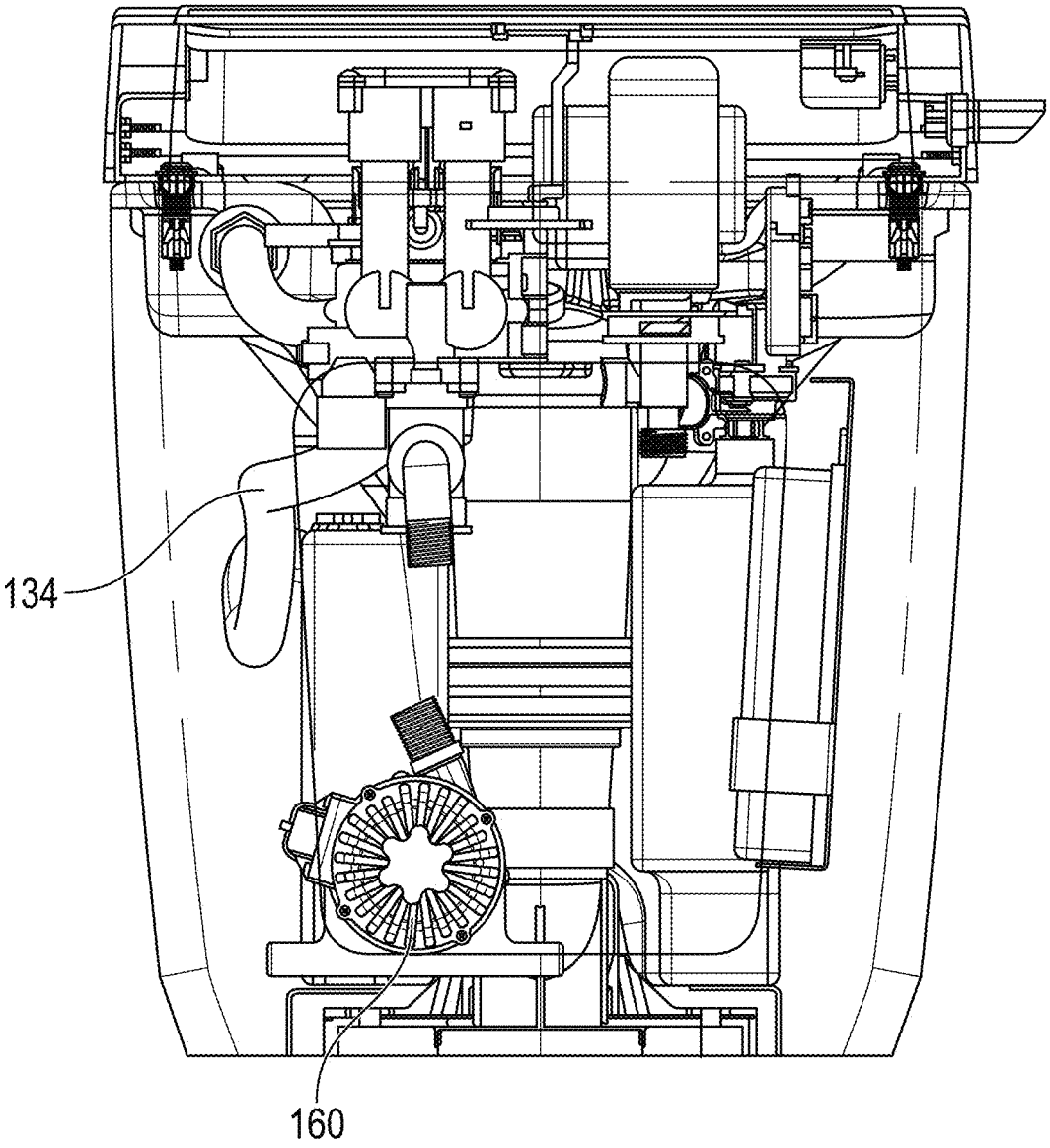
FIG. 5A is a rear perspective view of the toilet according to the first embodiment of the present utility model.
Figure 5B:
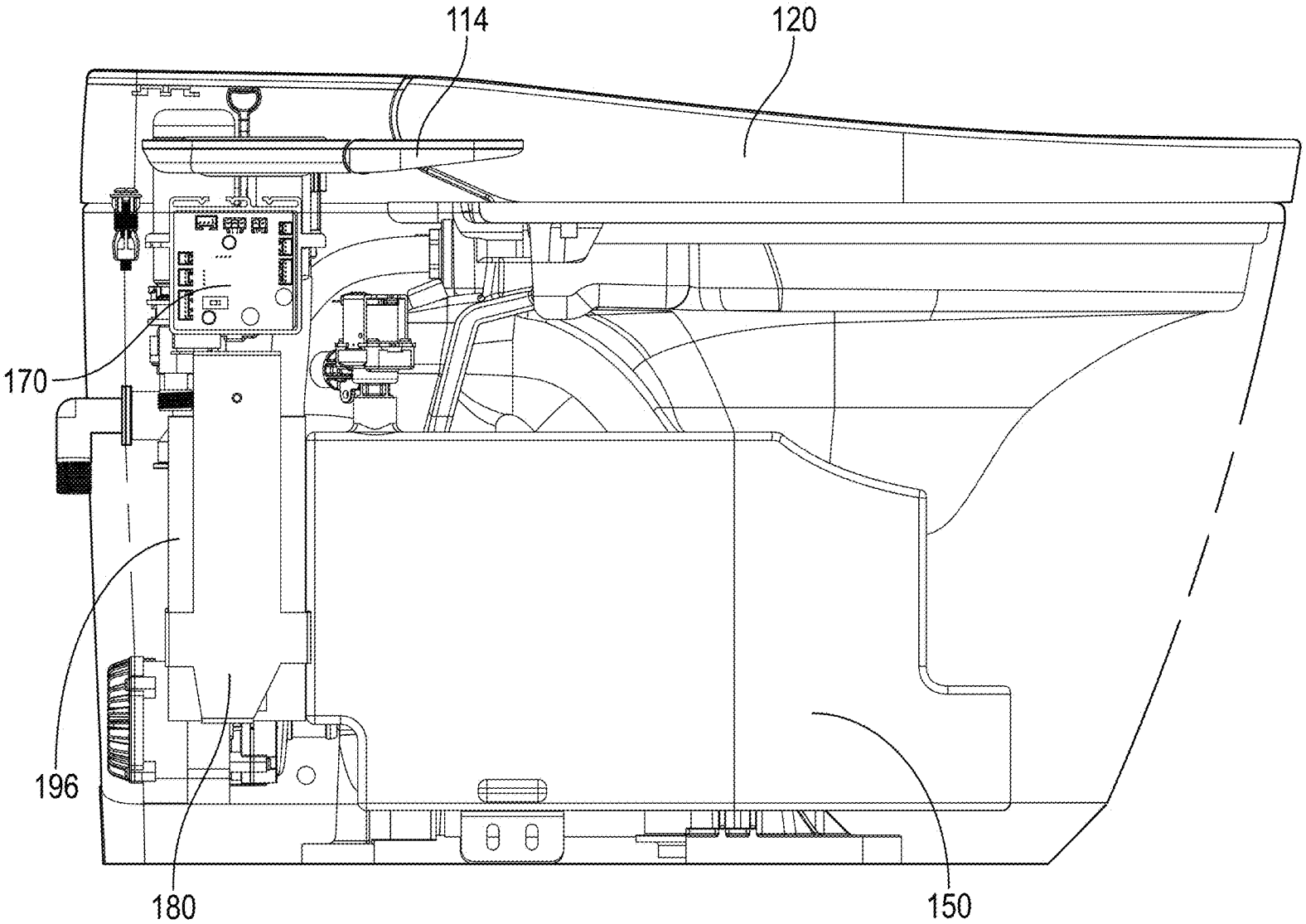
FIG. 5B is a left perspective view of the toilet according to the first embodiment of the present utility model.
Figure 5C:
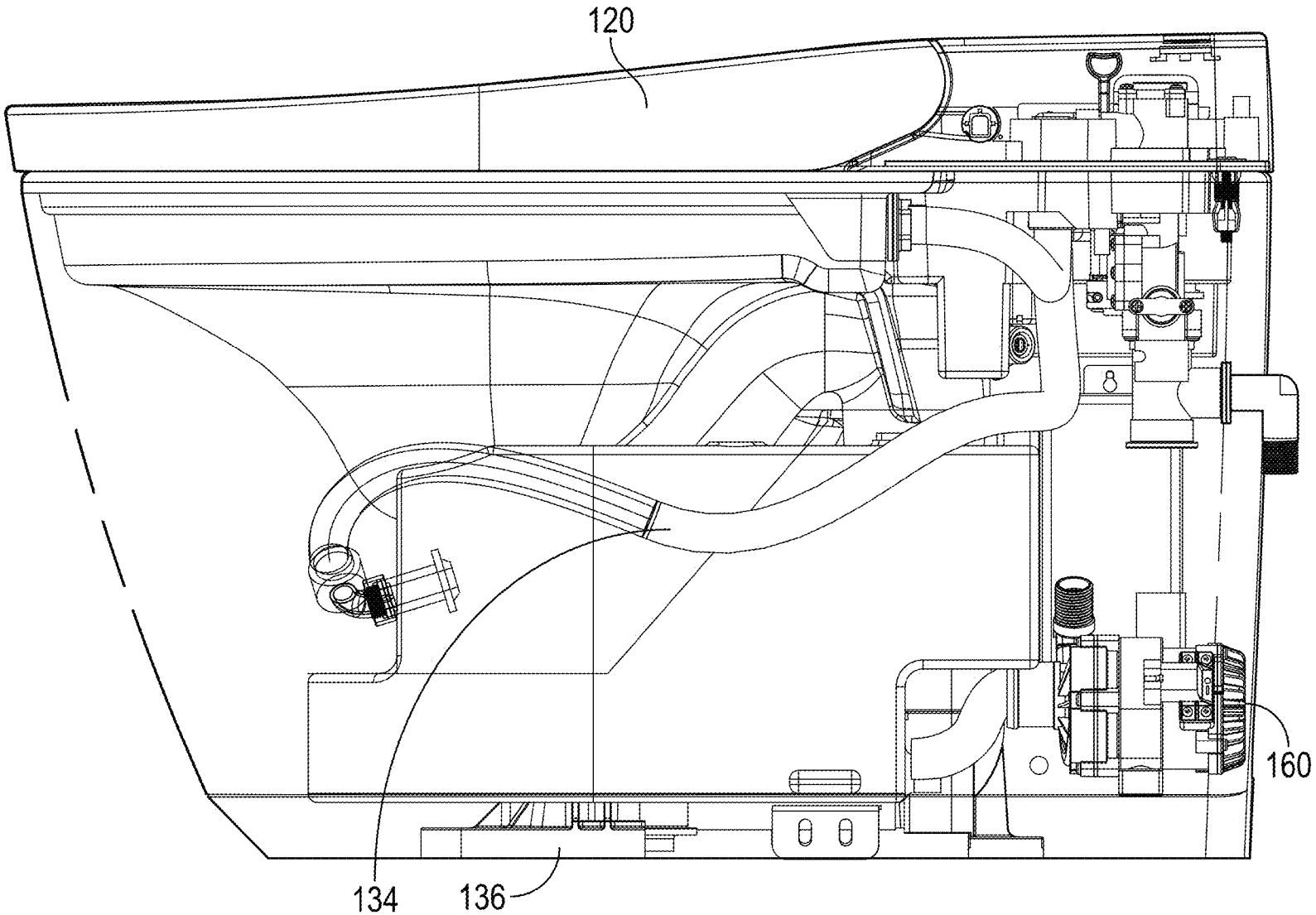
FIG. 5C is a right perspective view of the toilet according to the first embodiment of the present utility model.
Figure 5D:
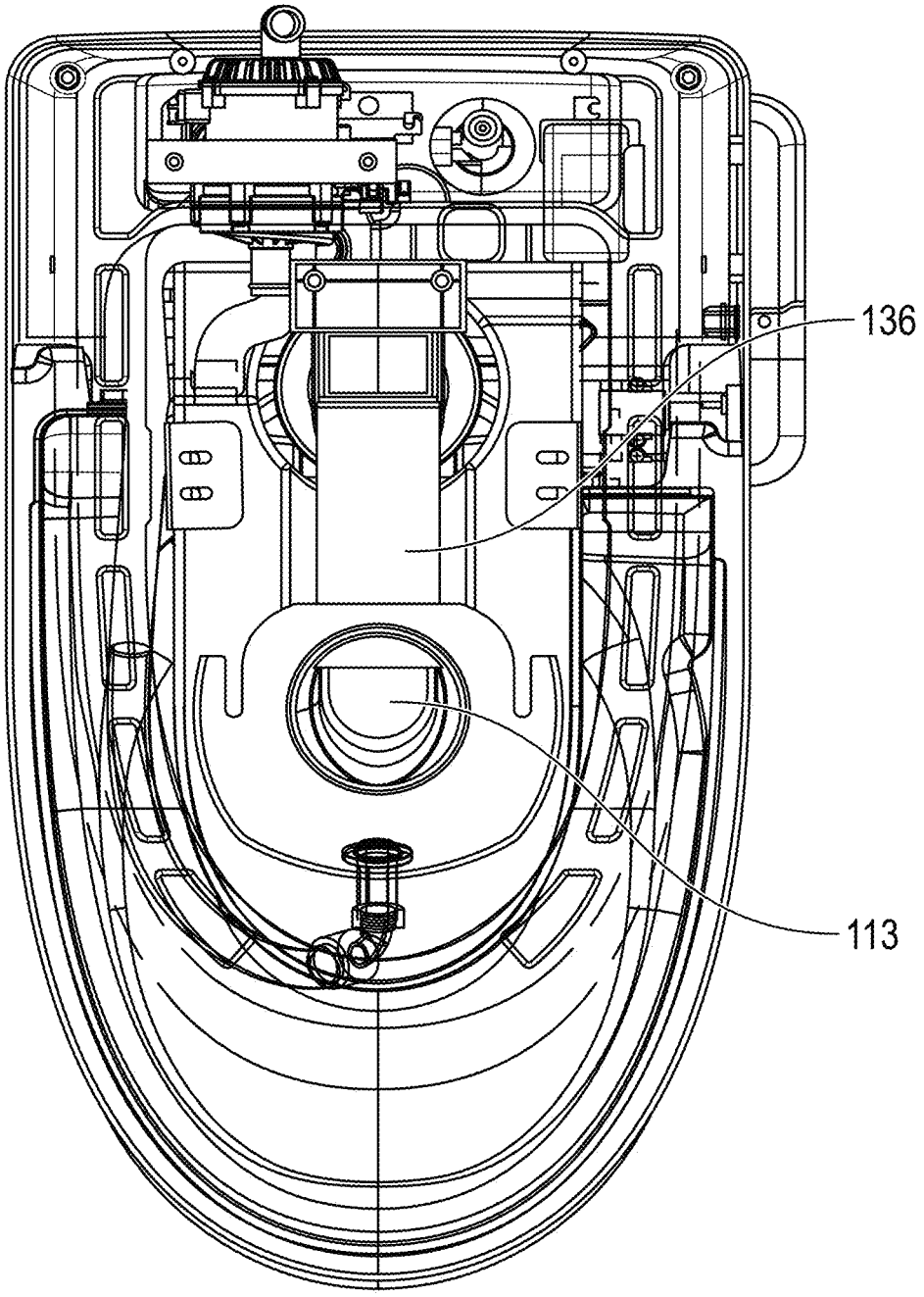
FIG. 5D is a bottom perspective view of the toilet according to the first embodiment of the present utility model.
Figure 5E:
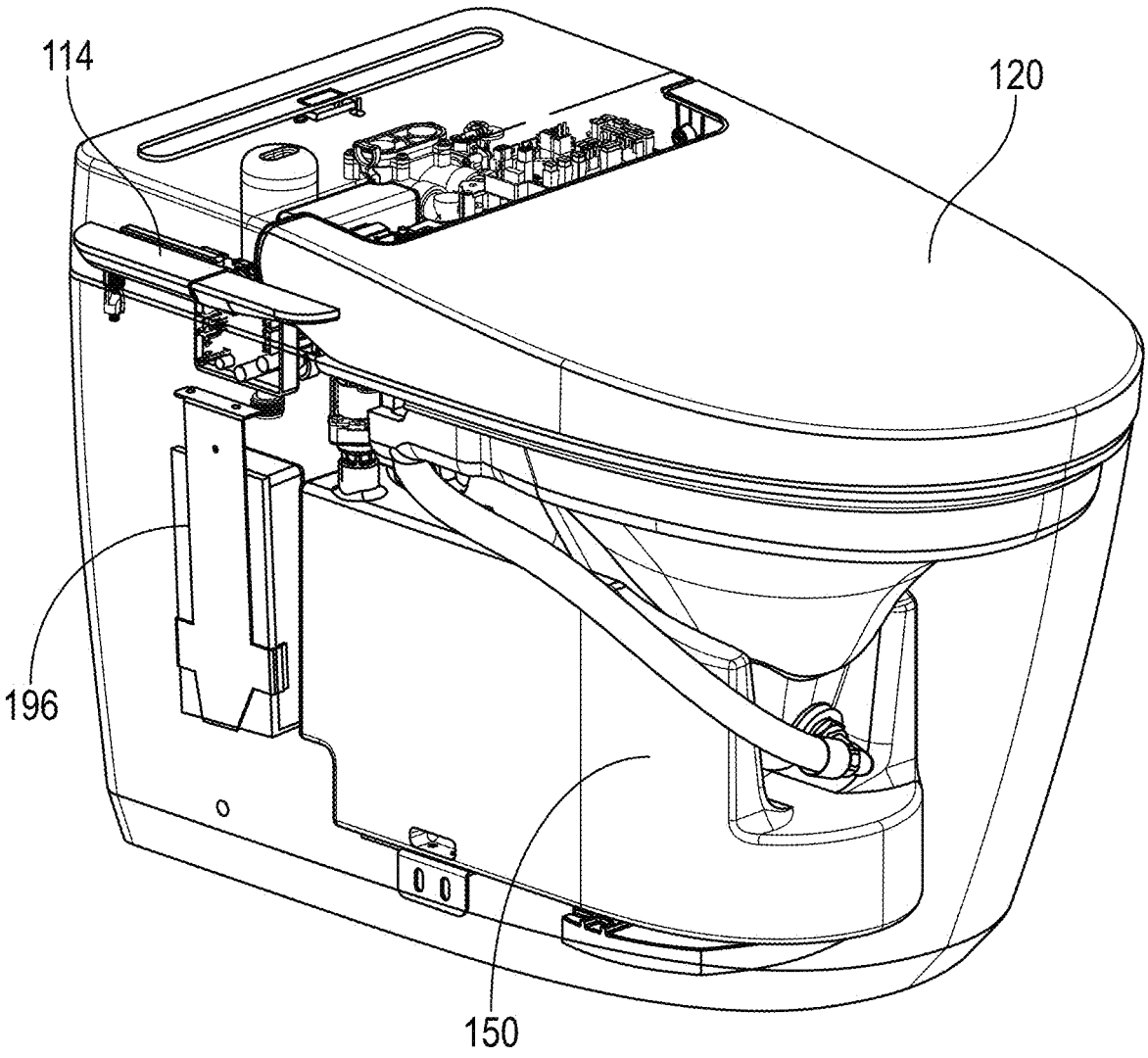
FIG. 5E is a stereoscopic perspective view of the toilet according to the first embodiment of the present utility model.
Figure 5F:
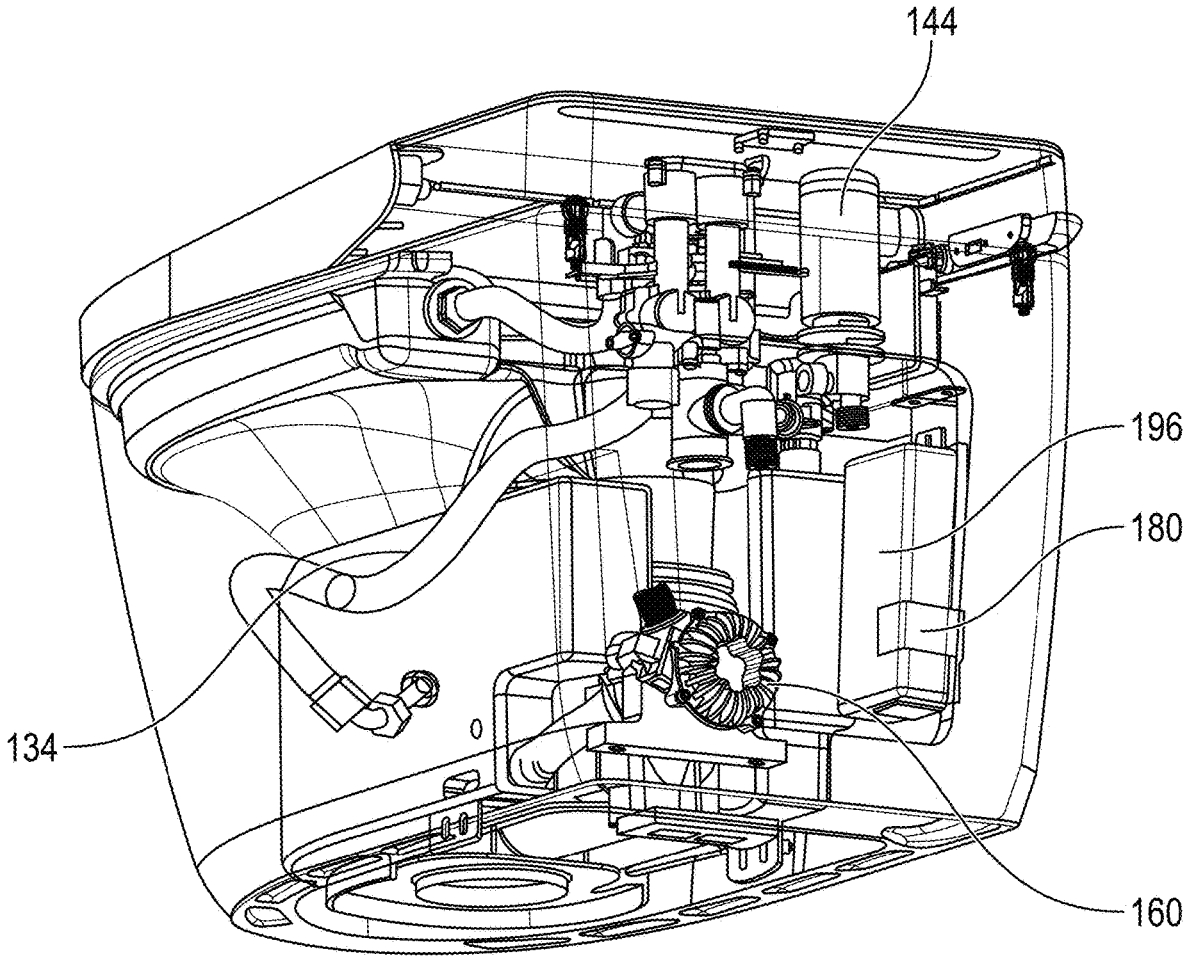
FIG. 5F is a stereoscopic perspective view of the toilet according to the first embodiment of the present utility model from another angle.

In order to supply power to the water pump 160, the toilet 100 may comprise a second power supply apparatus 196. The second power supply apparatus 196 may provide a voltage higher than the voltage of the first power supply apparatus. For example, in some cases, the first power supply apparatus may provide a voltage of about 12 volts, while the second power supply apparatus 196 may provide a voltage of about 24 volts. The second power supply apparatus 196 is also preferably arranged in the seat body 110, preferably adjacent to the position where the control circuit board 170 is located, as most clearly shown in FIG. 5B. The second power supply apparatus 196 may be supported by a bracket 180 (for example, see a sheet metal part shown in FIG. 1 or FIG. 5B) in the seat body 110. However, the present utility model does not exclude power supplying by one power supply apparatus, but the power supply apparatus must be capable of outputting different voltages, because the voltage provided to the water pump 160 is usually higher than voltage values provided to other electronic components.

In this first embodiment, the functions of the control circuit board 170 of the toilet 100 include but are not limited to: receiving a signal from the toilet switch 114 and sending an instruction of supplying power to the water pump 160 (for example, via the second power supply apparatus 196), so as to start a water pumping mode of the water pump 160; receiving a signal of the water level sensor located in the water tank 150, and sending a water inlet or water stop signal to the water inlet valve 146; and controlling the bottom flushing pipeline 134 (spray port 134*a*) and/or the ring flushing pipeline 132 (spray nozzle 132*a*) to control the timing sequence or flushing water amount and flushing time of the bottom flushing or the ring flushing (for example, controlling the second end 142*b* and the third end 142*c* connected to the spray port 134*a* or the spray nozzle 132*a* of the flush valve 142, and sending an instruction to the same by means of a preset program). In addition, the toilet 100 may also comprise a power board, which is used to connect the control circuit board 170 and the external power transmission power supply 192.

In the first embodiment, the seat body 110 of the toilet 100 is preferably adapted to the electronic toilet lid. The electronic toilet lid may be various types of electronic toilet lids that provide a heating function, a toilet cleaning function, a disinfection function, a drying function and the like. The first power supply apparatus located in the seat body 110 may supply power to the electronic toilet lid to meet the realization of various functions of the electronic toilet lid. FIGS. 5A-5F show an embodiment similar to the first embodiment, wherein the seat body is shown in a transparent manner to more clearly observe various components located in the seat body 110, for example, the second power supply apparatus 196, the control circuit board 170, etc.

Figure 2:
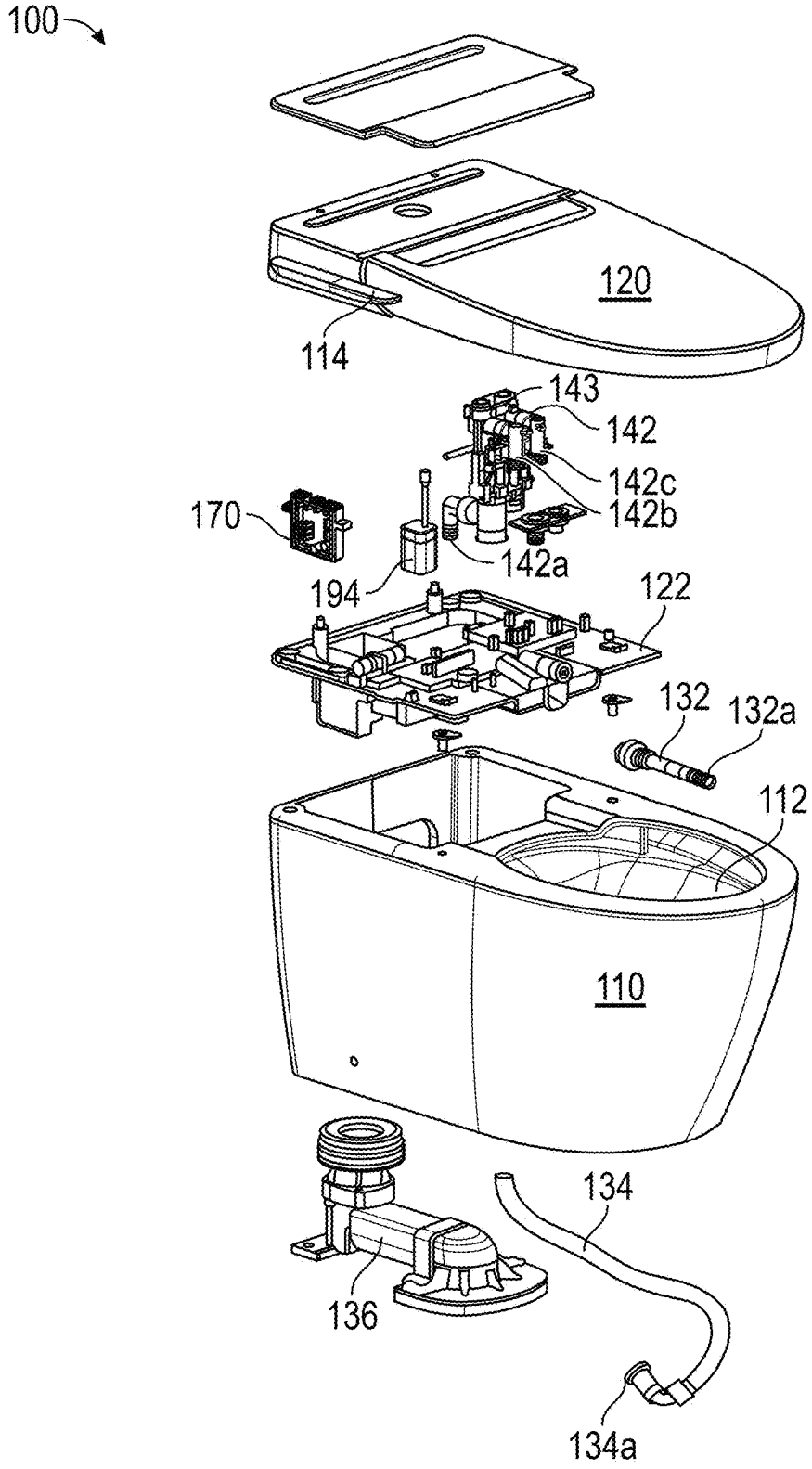
FIG. 2 exemplarily shows a structural perspective view of a toilet according to a second embodiment of the present utility model, wherein each component is installed in a seat body of the low-configuration toilet.

In a second embodiment as shown in FIG. 2, the toilet 100 is also implemented as a low-configuration toilet, but it does not comprise a water tank 150, but directly takes water from an external water source (e.g., a tap-water network). In this embodiment, the toilet 100 does not comprise a water pump, and thus does not comprise the second power supply apparatus 196 for supplying power to the water pump. However, in any case, the toilet 100 comprises a first power supply apparatus to supply power to components such as the flush valve 142. As mentioned above, the first power supply apparatus of the second embodiment should also be located in the seat body 110. In addition, the first power supply apparatus should also be arranged below the toilet lid.

The seat body 110 of the toilet 100 can be used in coordination with an electronic toilet lid or a traditional toilet lid. When the traditional toilet lid is employed, the first power supply apparatus may be implemented as a battery 194, when the electronic toilet lid is employed, the first power supply apparatus may be implemented as an external power transmission power supply 192 (see FIG. 3, for example), but vice versa. In any case, in both cases, the toilet 100 comprises the control circuit board 170, and power is supplied to various electronic components (e.g., the flush valve 142, the electronic toilet lid, etc.) via the control circuit board 170.

In this embodiment, similar to the first embodiment, in order to enable water to be sprayed out from the spray port 134*a* or the spray nozzle 132*a* as required, the flush valve 142 is also provided with a first end 142*a* communicated with the water outlet 160*b* of the water pump 160, a second end 142*b* communicated with the spray port 134*a* of the seat body 110, and a third end 142*c* communicated with the spray nozzle 132*a* of the seat body 110. Preferably, an air isolation apparatus 143 may also be disposed between the first end 142*a* of the flush valve 142 and the second end 142*b* or the third end 142*c* of the flush valve 142, so siphoning can be avoided when the spray port 134*a* or the spray nozzle 132*a* is lower than a water surface height in the toilet 100, which will cause the problem that dirty water in the toilet 100 flows back into the water inlet pipeline from the spray port 134*a* or the spray nozzle 132*a*, so as to ensure the cleanliness of a whole water network and avoid the water network pollution caused by sewage. Furthermore, a filter 144 may also be disposed between the water inlet pipeline and the flush valve 142, and the filter 144 is preferably located in a rear area in the seat body 110. In FIG. 1, the first port 144*a* connected to the water tank 150, the second port 144*b* connected to an external waterway, and the third port 144*c* connected to a toilet lid waterway of the filter 144 are exemplarily shown.

Preferably, a flow distribution valve may be arranged upstream the second end 142*b* and the third end 142*c* of the flush valve 142, for example, at the position of the first end 142*a* of the flush valve 142, so it is possible to choose either to communicate with the spray port 134*a* or the spray nozzle 132*a* by means of the flow distribution valve, then it is possible to further choose either to discharge water with the spray port 134*a* or the spray nozzle 132*a*, so as to meet the flushing needs of the users and save water resources.

In the second embodiment, the functions of the control circuit board 170 of the toilet 100 include but are not limited to: receiving a signal from the toilet switch 114 and sending an instruction of supplying power to the flush valve 142 to start the flushing process; and controlling the bottom flushing pipeline 134 (spray port 134*a*) and/or the ring flushing pipeline 132 (spray nozzle 132*a*) to control the timing sequence or flushing water amount and flushing time of the bottom flushing or the ring flushing (for example, controlling the second end 142*b* connected to the spray port 134*a* or the third end 142*c* connected to the spray nozzle 132*a* of the flush valve 142, and sending an instruction to the same by means of a preset program).

Compared with the second embodiment, the toilet 100 of the first embodiment can be referred to a "full-function"

toilet, because it can provide more functions, for example, using the water pump 160 to pump water, realizing the function of a complex electronic toilet lid, etc.

Figure 3:
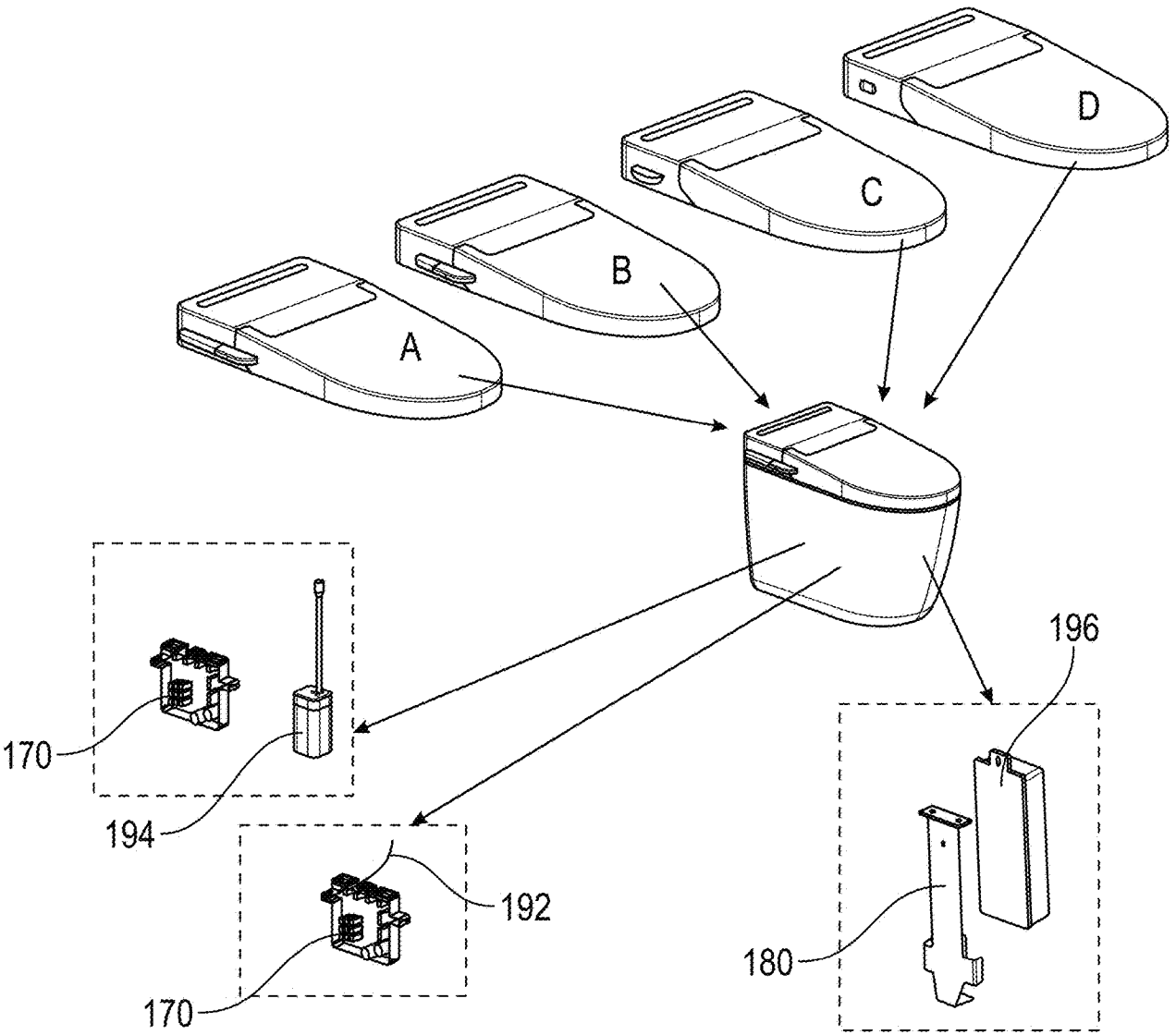
FIG. 3 exemplarily shows four possible toilet lids of toilets that can be matched with the seat bodies of the toilets according to the two embodiments of the present utility model, and possible power supply apparatuses and control circuit boards disposed in these seat bodies of the toilets.
Figure 4A:
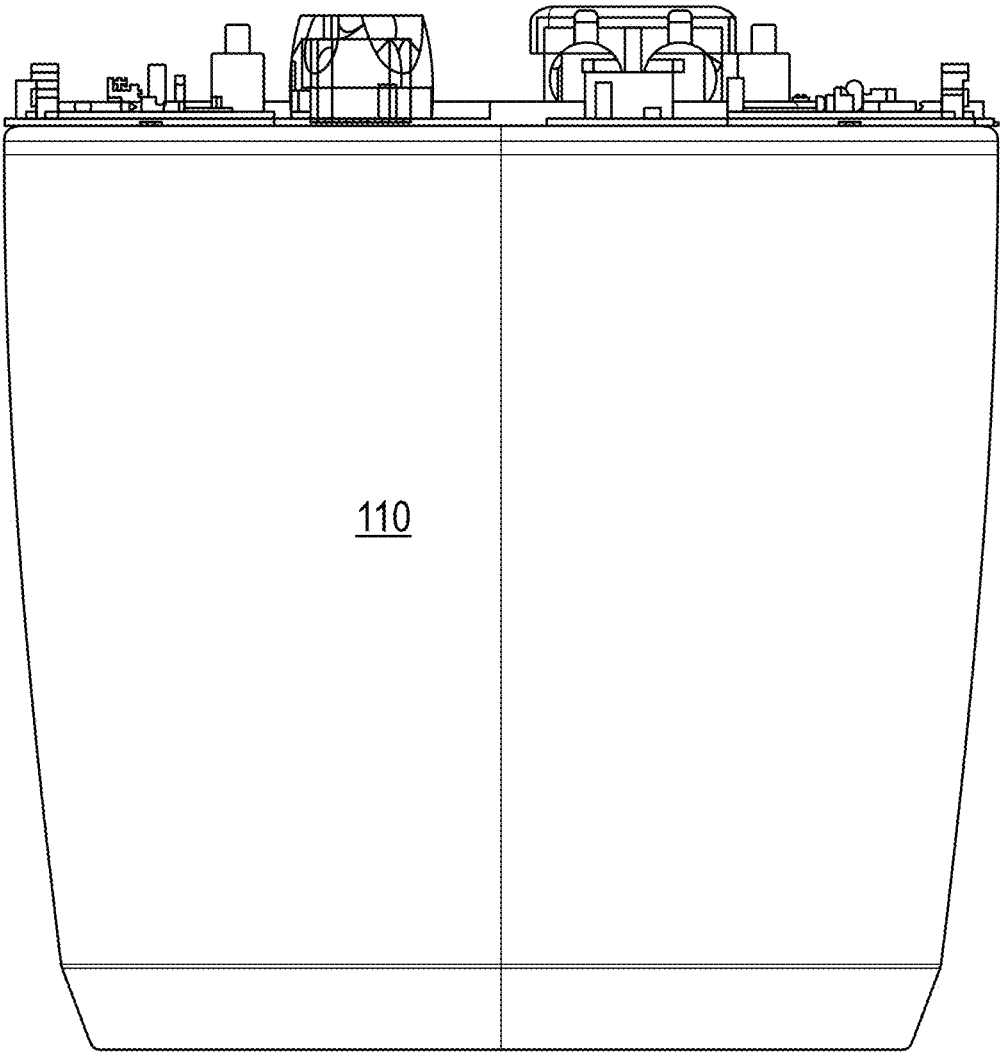
FIG. 4A is a front view of the toilet according to the first embodiment of the present utility model.
Figure 4B:
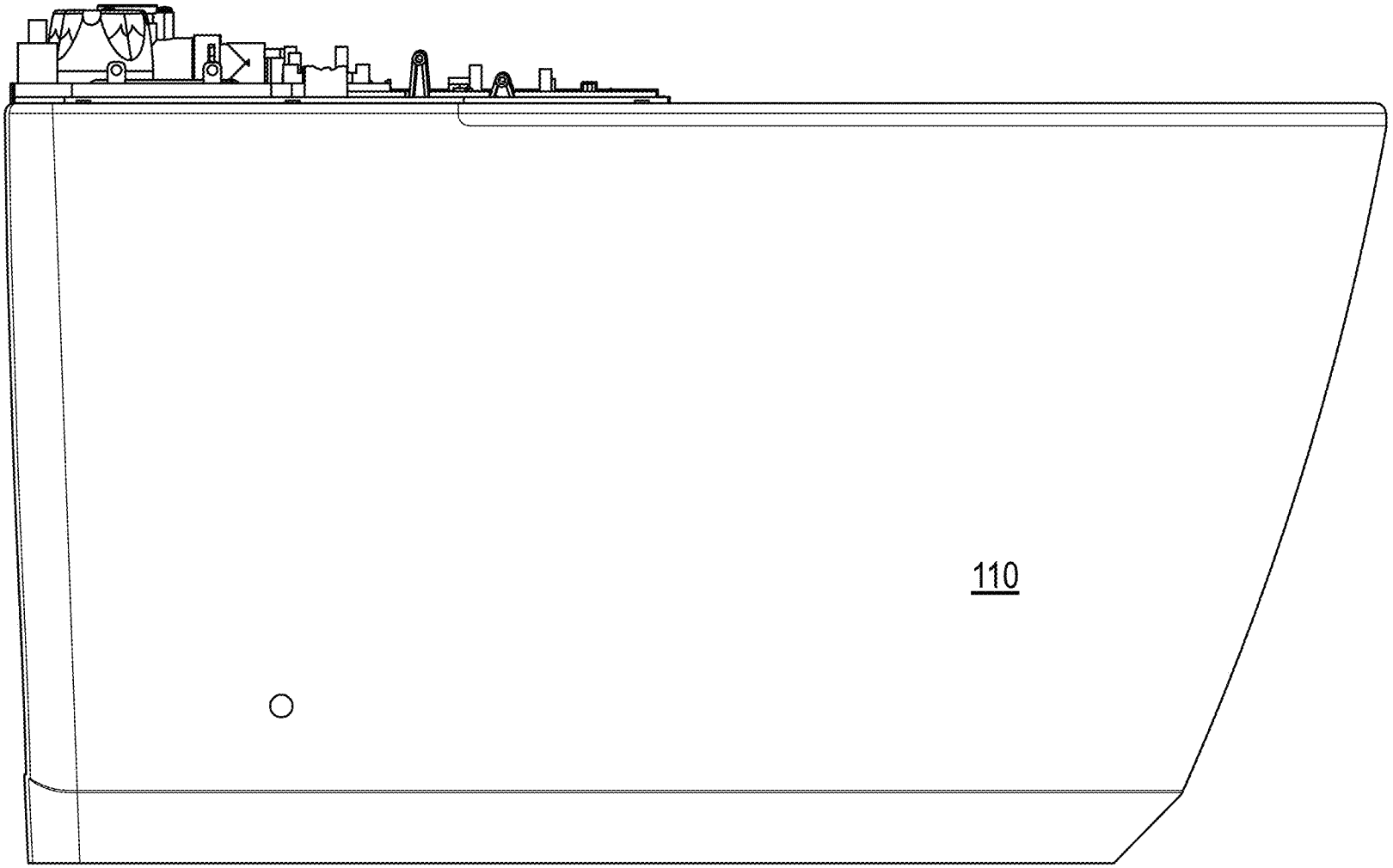
FIG. 4B is a left view of the toilet according to the first embodiment of the present utility model.
Figure 4C:
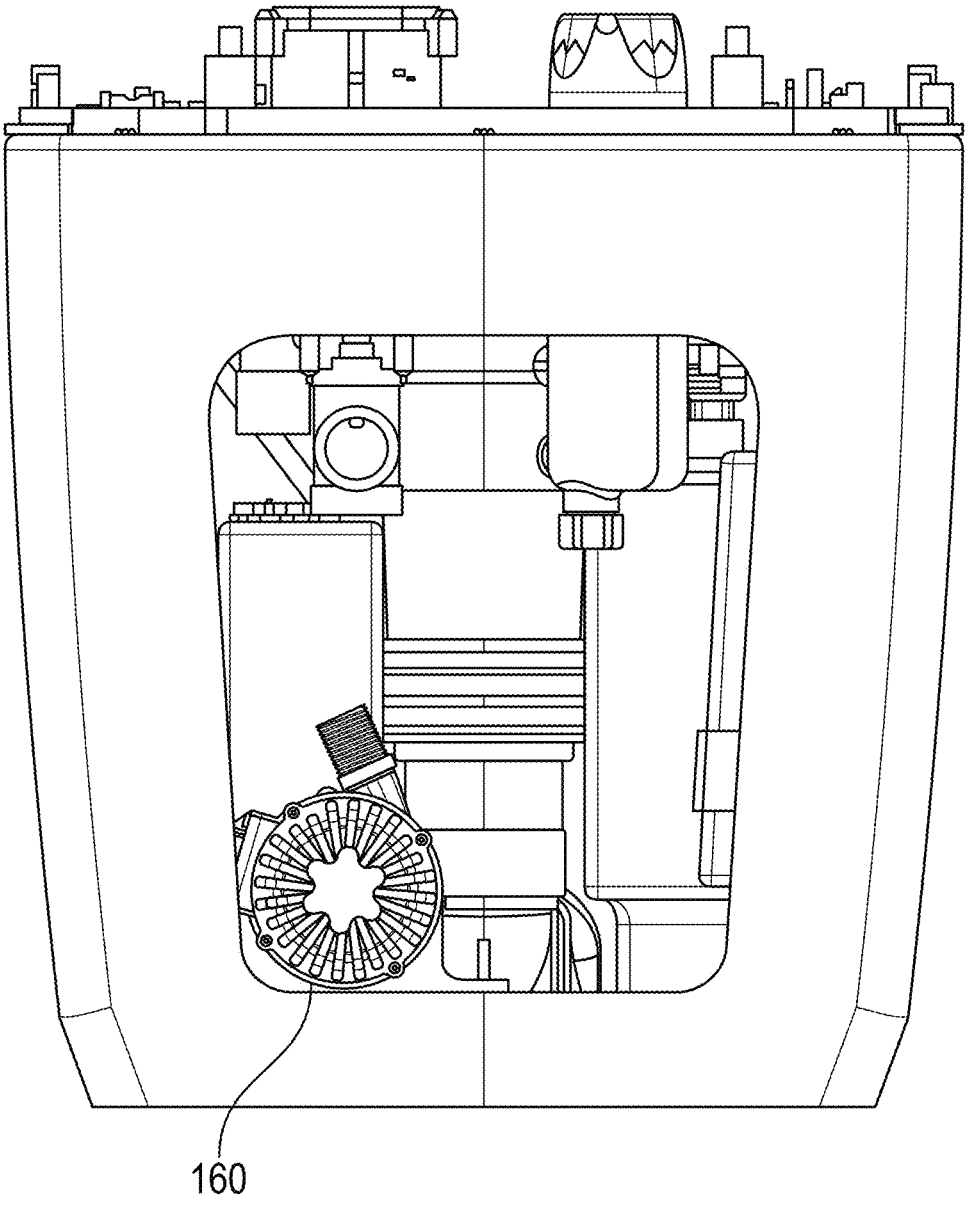
FIG. 4C is a rear view of the toilet according to the first embodiment of the present utility model.
Figure 4D:
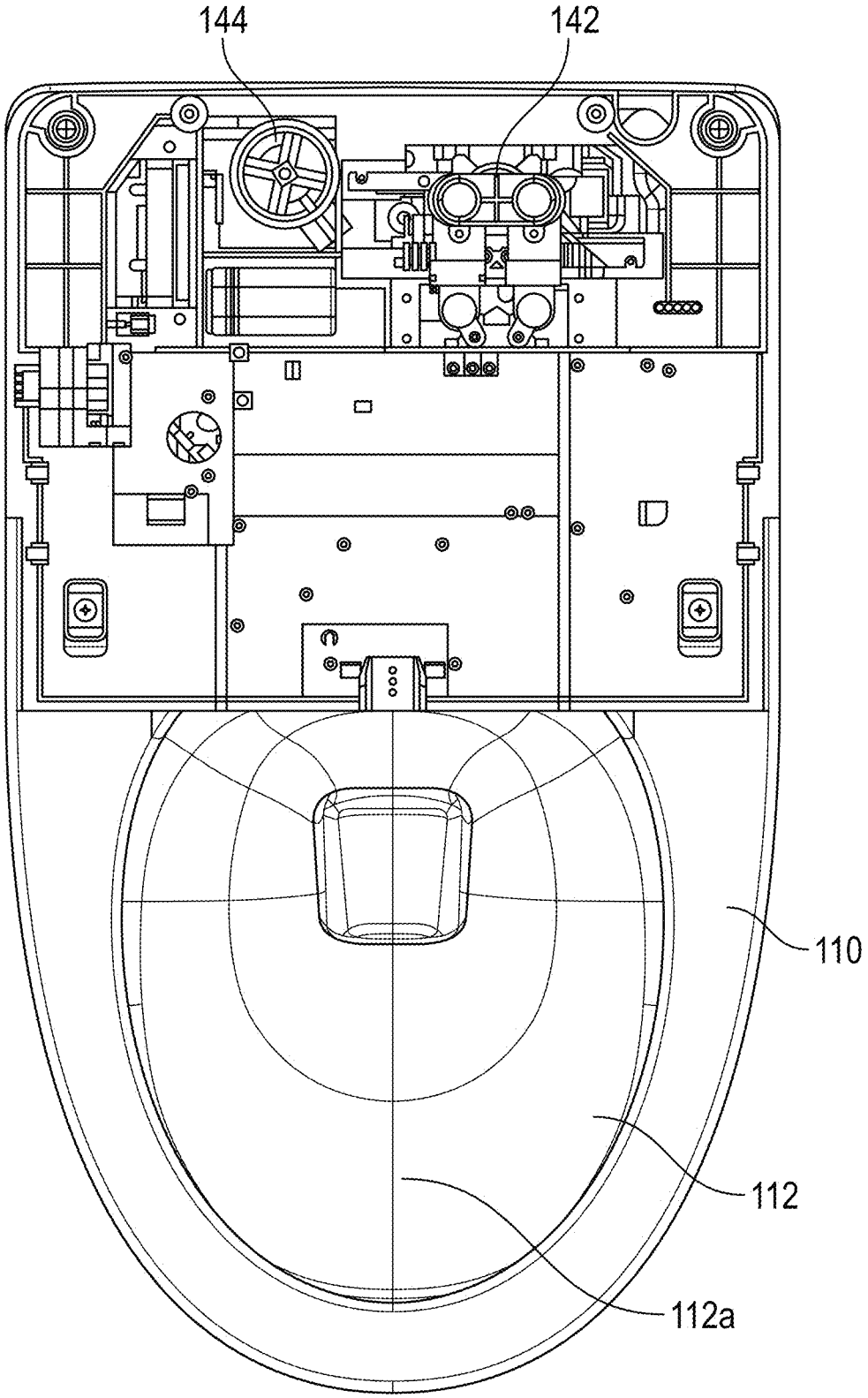
FIG. 4D is a top view of the toilet according to the first embodiment of the present utility model.

Finally, in FIG. 3, a variety of toilet lids that can be used in combination with the toilet seat 100 of the present utility model are exemplarily showed (different combination paths between the seat body and the toilet lid are indicated by thick lines and thin lines respectively). Specifically, in FIG. 3, the letters A, B, C and D are respectively used to indicate common cover plates (traditional cover plates without functions other than covering), non-electric flushing cover plates, simple intelligent cover plates and full-function cover plates. For example, toilet lids A and B can be used in combination with the seat body of the toilet of the aforementioned second embodiment, wherein a power supply 194 (for example, matched with a common toilet lid A) or an external power transmission power supply 192 can be used as the first power supply apparatus and the control circuit board 170 electrically connected to the first power supply apparatus. For another example, toilet lids C and D can be used in combination with the seat body 110 of the toilet of the aforementioned first embodiment, wherein a second power supply apparatus 196 for supplying power to the water pump 160 may further be provided (a bracket 180 for supporting the second power supply apparatus 196 is also shown herein) in addition to having the first power supply apparatus (for example, a battery 194 that can supply power to the electronic toilet lid) or an external power transmission power supply 192.

It can be understood that the seat body 110 of the toilet according to the present utility model can be combined with more types of toilet lids, for example, toilet lids with only a heating function, etc., which will not be repeated here.

Although various embodiments of the present utility model have been described in the drawings with reference to embodiments of a toilet capable of performing ring flushing and bottom flushing, it should be understood that embodiments within the scope of the present utility model are applicable to sanitary devices having similar structures and/or functions.

The foregoing description has presented many features and advantages, including various alternative embodiments, as well as structural and functional details of the apparatus and method. The present utility model is intended to be exemplary, and not exhaustive or limiting.

It would be obvious for those skilled in the art that various modifications can be made within the full range indicated by the broad superordinate meanings of the terms expressed in the appended Claims, especially in the aspects of structures, materials, elements, components, shapes, sizes and arrangement of components, including the combination of these aspects within the scope of the principles described herein. To the extent that these various modifications do not depart from the spirit and scope of the appended Claims, it is meant that they are also included herein.

The invention claimed is:

1. A toilet (100) comprising a seat body (110) having a sewage accommodating bowl (112);

a ring flushing pipeline (132) for performing ring flushing on the sewage accommodating bowl (112);

a bottom flushing pipeline (134) for performing bottom flushing on the sewage accommodating bowl (112);

a flushing port positioned at an upper inner edge of the sewage accommodating bowl, and a flush valve (142) in fluid communication with the ring flushing pipeline and the bottom flushing pipeline, such that water for flushing flows to the sewage accommodating bowl (112) via the flush valve (142);

wherein a first power supply apparatus is arranged in the seat body (110), the first power supply apparatus is configured to supply power to the flush valve (142), and the ring flushing pipeline comprises a spray nozzle positioned at the flushing port.

2. The toilet according to claim 1, wherein the toilet further comprises a water tank (150) configured to contain water for flushing; and a water level sensor disposed in the water tank (150) to sense a water level in the water tank (150);

wherein the first power supply apparatus is configured to supply power to the water level sensor.

3. The toilet according to claim 2, wherein the toilet further comprises an electronic toilet lid (120) disposed on the seat body (110), and the first power supply apparatus is configured to supply power to the electronic toilet lid.

4. The toilet according to claim 3, wherein a control circuit board (170) is disposed in the seat body (110), the first power supply apparatus is an external power transmission power supply or a battery (194), and the external power transmission power supply and the battery (194) can be electrically connected to the control circuit board (170), so as to supply power via the control circuit board (170).

5. The toilet according to claim 1, wherein flushing water flowing from the ring flushing pipeline through the flushing port is configured to rotate on the sewage accommodating surface.

6. The toilet according to claim 4, wherein the water tank (150) is at least partially disposed in the seat body (110), a water pump (160) connected to the water tank (150) is disposed in the seat body (110), and the water pump (160) is configured to pump water in the water tank (150) and deliver the pumped water to the flush valve (142) at a pressure.

7. The toilet according to claim 6, wherein a second power supply apparatus (196) for supplying power to the water pump (160) is disposed in the seat body (110), and a voltage provided by the second power supply apparatus (196) is higher than a voltage provided by the first power supply apparatus.

8. The toilet according to claim 7, wherein the flush valve (142) comprises a first end (142*a*) in communication with a water outlet of the water pump (160), a second end (142*b*) in communication with a spray port (134*a*) of the seat body (110), and a third end (142*c*) in communication with the spray nozzle (132*a*), and an air isolation apparatus (143) disposed between the first end (142*a*) and the second end (142*b*) or the third end (142*c*), configured to prevent water from flowing back into the water tank (150).

9. The toilet according to claim 6, wherein the toilet comprises a toilet switch (114), and the control circuit board (170) is in communication with the toilet switch (114), such that an instruction to supply power to the water pump (160) can be sent in response to a signal from the toilet switch (114), in order for the water pump (160) to start pumping water.

10. The toilet according to claim 4, wherein the toilet comprises a water inlet valve (146), water is configured to flow into the water tank (150) through the water inlet valve (146), and the control circuit board (170) is in communication with the water level sensor, so that opening and closing of the water inlet valve (146) can be controlled in response to a signal of the water level sensor.

11. The toilet according to claim 5, wherein the control circuit board (170) is in communication with the flush valve (142), so that a flushing water amount and/or a flushing timing of the ring flushing or the bottom flushing via the flush valve (142) can be controlled.

12. The toilet according to claim 6, wherein the water tank (150) is disposed at a bottom in the seat body (110).

13. The toilet according to claim 3, wherein the first power supply apparatus is disposed in a space below a base plate (122) of the toilet lid in the seat body (110).

14. The toilet according to claim 5, wherein the water tank (150) is at least partially disposed in the seat body (110), a water pump (160) connected to the water tank (150) is disposed in the seat body (110), and the water pump (160) is configured to pump water in the water tank (150) and deliver the pumped water to the flush valve (142) at a pressure.

15. The toilet according to claim 4, wherein the first power supply apparatus is disposed in a space below a base plate (122) of the toilet lid in the seat body (110).

16. The toilet according to claim 5, wherein the first power supply apparatus is disposed in a space below a base plate (122) of the toilet lid in the seat body (110).

17. The toilet according to claim 1, comprising a manifold in communication with the flush valve, the ring flushing pipeline, and the bottom flushing pipeline.

* * * * *